US010544019B2

(12) United States Patent
Kochie et al.

(10) Patent No.: US 10,544,019 B2
(45) Date of Patent: Jan. 28, 2020

(54) SCISSOR LIFT WITH HYDRAULIC PULLING CYLINDER

(71) Applicants: Bosch Automotive Service Solutions Inc., Warren, MI (US); Robert Bosch GmbH, Stuttgart (DE)

(72) Inventors: Robert Kochie, Dodge Center, MN (US); Corday Peterson, Owatonna, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 611 days.

(21) Appl. No.: 14/975,151

(22) Filed: Dec. 18, 2015

(65) Prior Publication Data

US 2017/0174486 A1 Jun. 22, 2017

(51) Int. Cl.

| | |
|---|---|
| ***B66F 7/06*** | (2006.01) |
| ***B66F 3/22*** | (2006.01) |
| ***B66F 7/08*** | (2006.01) |

(52) U.S. Cl.

CPC ..... *B66F 7/065* (2013.01); *B66F 7/08* (2013.01)

(58) Field of Classification Search

None

See application file for complete search history.

(56) References Cited

U.S. PATENT DOCUMENTS

| | | | | | |
|---|---|---|---|---|---|
| 2,931,519 | A * | 4/1960 | Beach | B66F 7/0625 | 254/134 |
| 3,615,087 | A * | 10/1971 | Hickman | B25B 1/02 | 108/115 |
| 3,618,220 | A * | 11/1971 | Skelton | A63C 11/26 | 33/644 |
| 4,577,821 | A * | 3/1986 | Edmo | B66F 7/08 | 108/145 |
| 5,322,143 | A * | 6/1994 | Curran | B66F 7/065 | 187/211 |
| 5,429,210 | A * | 7/1995 | Hansen | B66B 9/16 | 187/243 |
| 5,503,368 | A * | 4/1996 | Torres | B66F 7/0608 | 254/122 |
| 6,098,961 | A * | 8/2000 | Gionet | B66F 7/065 | 254/122 |
| 6,619,620 | B1 * | 9/2003 | Carter | B66F 7/0625 | 254/10 C |
| 9,114,547 | B2 * | 8/2015 | Kinsler | B27C 1/14 | |

* cited by examiner

*Primary Examiner* — Joseph J Hail
*Assistant Examiner* — Brian D Keller
(74) *Attorney, Agent, or Firm* — Maginot, Moore & Beck LLP

(57) ABSTRACT

A lift device configured to lift an object includes a stationary base, a lift assembly, a support assembly, and a lift mechanism. The lift assembly is movably coupled to the base, and the support assembly is movably coupled to the lift assembly. The support assembly is configured to support the object. The lift mechanism has an adjustable length. The lift mechanism is coupled to the base and to the lift assembly such that decreasing the length of the lift mechanism moves the support assembly upwardly and increasing the length of the lift mechanism moves the support assembly downwardly.

9 Claims, 4 Drawing Sheets

SCISSOR LIFT WITH HYDRAULIC PULLING CYLINDER

TECHNICAL FIELD

This disclosure relates to mechanized lifts and, more specifically to mechanized scissor lifts.

BACKGROUND

Mechanized lifts are commonly used to raise and lower heavy objects that would be difficult to raise and lower manually due to weight and size. For example, mechanized lifts are commonly used to raise and lower vehicles, including smaller vehicles like motorcycles and other smaller all-terrain vehicles. It is useful to raise a vehicle, such as a motorcycle, and hold it in the raised position in order to perform an action on the motorcycle, such as, cleaning, maintenance, repair, or making other modifications to the motorcycle.

One issue with using mechanized lifts to raise and lower a motorcycle is how to stably support the motorcycle on the lift so that the motorcycle does not lean or fall while on the lift. Furthermore, motorcycles are produced with a wide variety of shapes and sizes. Accordingly, it is desirable to have a single lift which is versatile and can stably support a variety of motorcycles.

It is also desirable to have a mechanized lift which is easy to raise and lower. Ease of raising and lowering the lift reduces time and energy spent prior to and following the actual action being performed on the motorcycle. Additionally, ease of raising and lowering the lift reduces risk of injury to someone operating the mechanized lift and enables more people to use the lift by reducing the strength required by the user.

Finally, it is also desirable to have a mechanized lift which has a compact size. A more compact lift takes up less room in a space where the lift is being stored and operated. A more compact lift is also easier to relocate. A more compact lift also provides greater access to the motorcycle that is on the lift because the compact lift does not block as much access to the motorcycle.

SUMMARY

In accordance with one embodiment of the present disclosure, a lift device for supporting and lifting an object, such as, for example, a motorcycle or an all-terrain vehicle, is disclosed herein. The lift device includes a support assembly for supporting the object to facilitate access to the object such as, for example, to perform maintenance or other work. The support assembly is raised and lowered by a lift assembly including two pairs of scissor legs. The scissor legs of the lift assembly are operated by a lift mechanism, which is supported by a base, to bring the scissor legs toward and away from the base. In at least one embodiment, the lift mechanism includes a hydraulic pulling cylinder coupled to the lift assembly such that when the cylinder contracts, and a length of the lift mechanism is shortened, the lift assembly raises the support assembly. Conversely, when the cylinder expands, and a length of the lift mechanism is lengthened, the lift assembly lowers the support assembly. Accordingly, the lift mechanism is a hydraulic pulling cylinder.

The support assembly includes two arms, each arm arranged in contact with one of the pairs of scissor arms. In at least one embodiment, each of the arms includes at least one pad which is adjustable along the arm. For example, each of the arms can include two pads which are adjustable along the arm. The support assembly further includes an adjustment mechanism arranged on each of the two arms. The adjustment mechanism adjusts the position of the pads along the corresponding arm. The pads support the object on the lift device.

DETAILED DESCRIPTION

Figure 1:
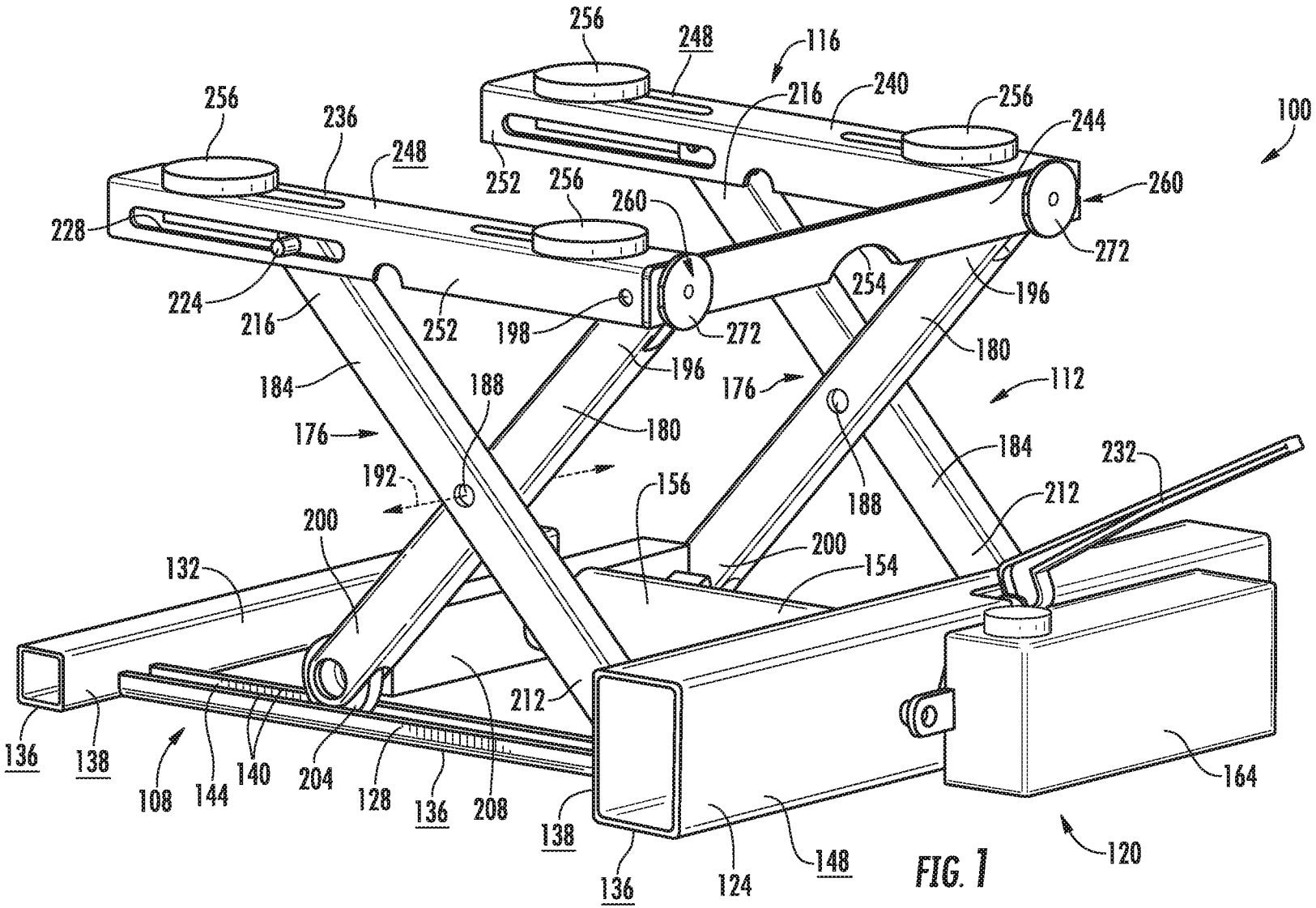
FIG. 1 depicts a perspective view of a lift device of the present disclosure.
Figure 2:
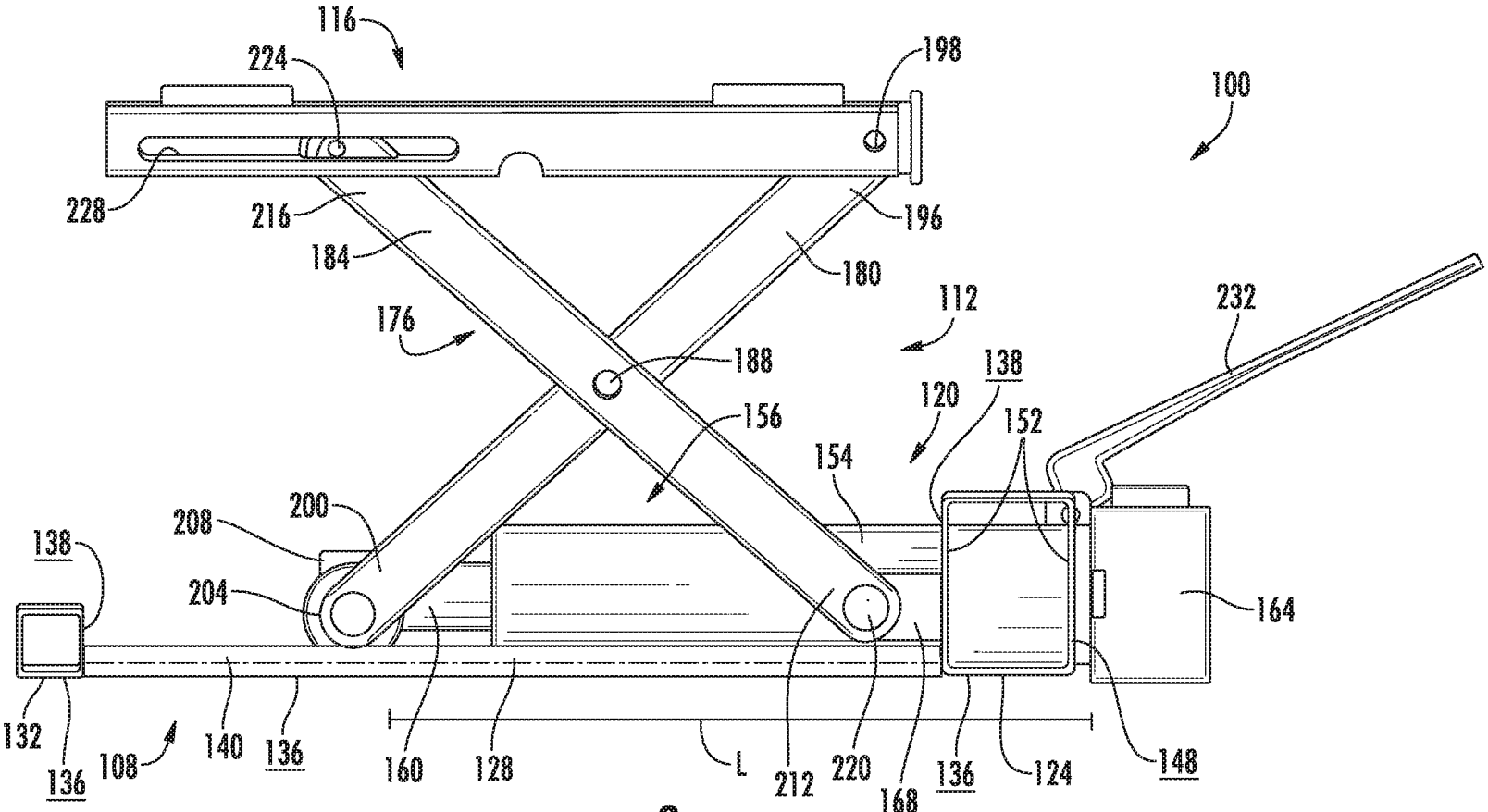
FIG. 2 depicts a side view of the lift device of FIG. 1 in a raised position.
Figure 3:
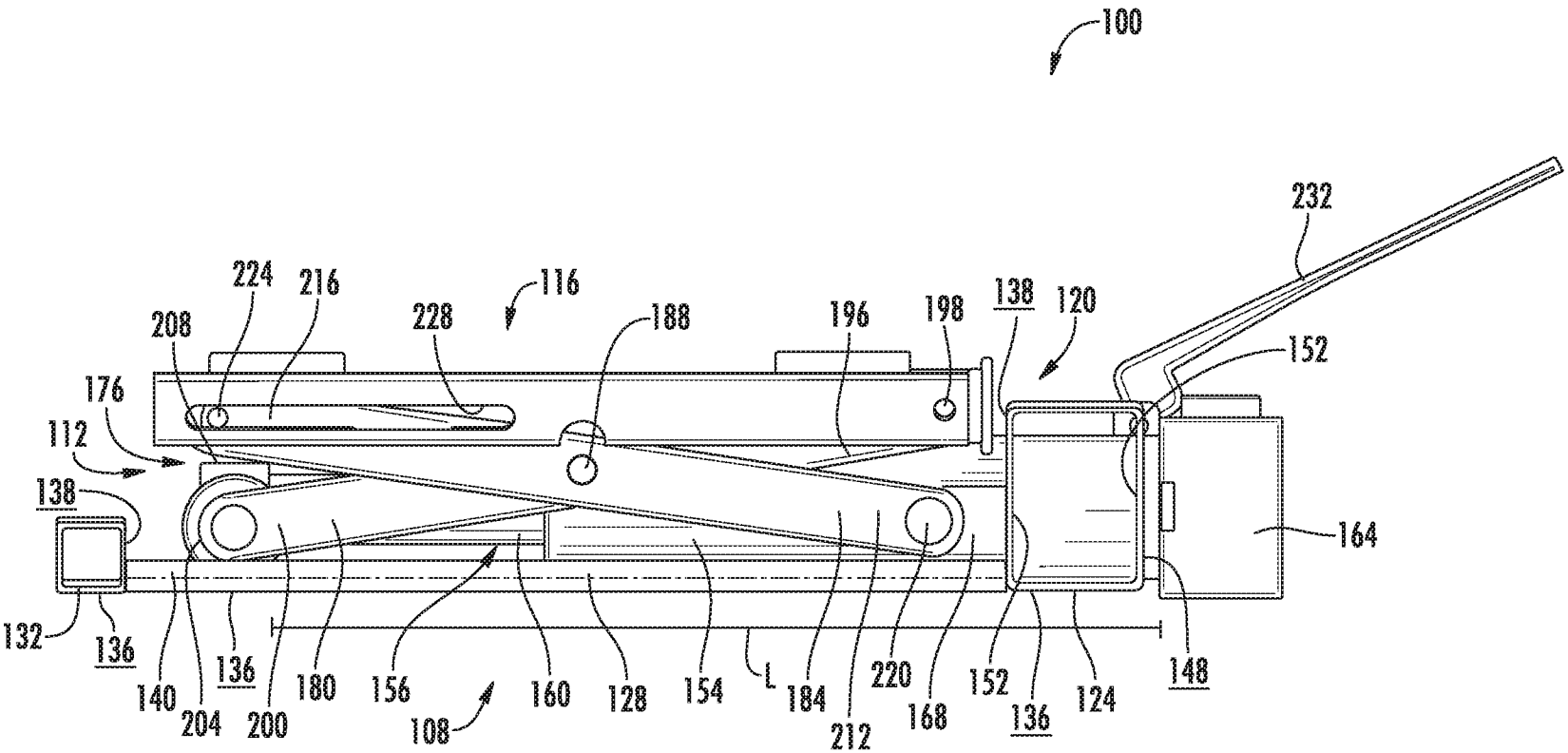
FIG. 3 depicts a side view of the lift device of FIG. 1 in a lowered position.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one of ordinary skill in the art to which this disclosure pertains FIGS. 1-3 depict a lift device 100 configured to support and lift an object, such as, for example, a motorcycle or an all-terrain vehicle. The lift device 100 includes a base 108, a lift assembly 112, a support assembly 116, and a lift mechanism 120. The base 108 is configured to remain stationary and provide a stable support for the lift device 100. The lift assembly 112 is movably coupled to the base 108, the support assembly 116, and the lift mechanism 120, and is configured to raise and lower the support assembly 116 relative to the base 108. The lift mechanism 120 has an adjustable length L (shown in FIGS. 2 and 3) and is fixedly coupled to the base 108 and movably coupled to the lift assembly 112. The lift mechanism 120 operates the lift assembly 112 to raise and lower the support assembly 116 relative to the base 108.

More specifically, the base 108 includes a support beam 124, two rails 128, and a further support beam 132. The support beam 124 and the further support beam 132 are arranged opposite and parallel to one another. In the embodiment shown, the support beam 124 and the further support beam 132 are made of hollow square tubes, and one side of each of the tubes provides a lowermost surface 136 for the base 108 to rest on the ground or floor. Thus, the support beam 124 and further support beam 132 are shaped so as to provide stable and sturdy surfaces 136 on which the base 108 can rest and, because they are hollow, they do not add unnecessary weight to the lift device 100. In alternative embodiments, the support beam 124 and further support beam 132 can have different shapes which provide stable and sturdy surfaces on which the base 108 can rest and which do not add unnecessary weight to the lift device 100.

The rails 128 are arranged opposite and parallel to one another and each rail 128 is affixed to an inwardly facing surface 138 of the support beam 124 and an inwardly facing surface 138 of the further support beam 132 such that the support beam 124, further support beam 132, and rails 128 form a rectangular shape for the base 108. In the embodiment shown, each of the rails 128 is u-shaped, having a lowermost surface 136 and side walls 140. The side walls 140 form a groove 144 (shown in FIG. 1) therebetween which faces upwardly in a direction opposite the lowermost surface 136. The lowermost surface 136 of each of the rails 128 is coplanar with the lowermost surfaces 136 of the support beam 124 and the further support beam 132 to further provide a stable and sturdy surface on which the base 108 can rest.

The support beam 124 includes an outwardly facing surface 148 arranged opposite the inwardly facing surface 138. Each of the outwardly facing surface 148 and the inwardly facing surface 138 of the support beam 124 includes an opening 152 configured to receive a barrel 154 of a hydraulic cylinder 156 of the lift mechanism 120 therethrough. The arrangement of the barrel 154 in the openings 152 couples the lift mechanism 120 to the base 108. The lift mechanism 120 is coupled to the base 108 such that a piston 160 (shown in FIGS. 2 and 3) of the hydraulic cylinder 156, received within the barrel 154, is always arranged within the base 108, and a power source 164 of the hydraulic cylinder 156 is always arranged outside the base 108.

The support beam 124 further includes two tabs 168 (one of which is shown in each of FIGS. 2 and 3). Each of the tabs 168 extends from an opposite end of the inwardly facing surface 138 of the support beam 124 toward the inwardly facing surface 138 of the further support beam 132. The tabs 168 are arranged farther from one another on the support beam 124 than the rails 128. In other words, the tabs 168 are arranged outside the rails 128. The tabs 168 are also spaced apart from the lowermost surface 136 of the support beam 124. In other words, the tabs 168 are arranged above the rails 128. Each of the tabs 168 is coupled to a pair of scissor legs 176 of the lift assembly 112.

The lift assembly 112 includes two pairs of scissor legs 176 (one of which is shown in each of FIGS. 2 and 3), each of which is coupled to the support assembly 116, the base 108, and the lift mechanism 120. Each pair of scissor legs 176 includes a first leg 180 and a second leg 184 rotatably coupled together at a hinge 188. In other words, each first leg 180 is able to rotate relative to the second leg 184 of its pair of scissor legs 176 about a rotation axis 192 (shown in FIG. 1) formed at the hinge 188.

Each of the first legs 180 includes a first end 196 and a second end 200. The first end 196 of each first leg 180 is rotatably coupled to the support assembly 116 at a fixed location 198, and the second end 200 of each first leg 180 is slidably coupled to the base 108. More specifically, the second end 200 of each first leg 180 includes a slider 204 configured to slide along a respective rail 128. In the embodiment shown, the sliders 204 are wheels rotatably coupled to the second end 200 of each first leg 180 and configured to fit into the groove 144 (shown in FIG. 1) between the side walls 140 of the respective rail 128. The wheels rotate to accommodate movement of the second ends 200 of the first legs 180, the wheels slide or roll along the rails 128. In alternative embodiments, the sliders 204 do not have to be wheels, and the rails 128 do not have to include grooves. In alternative embodiments, the sliders 204 and the rails 128 can be formed in a different manner such that the sliders 204 slide or roll along the rails 128.

The second ends 200 of the first legs 180 are fixed in relation to one another by a crossbar 208 of the lift mechanism 120. The crossbar 208 is coupled to the second end 200 of each of the first legs 180 such that the crossbar 208 is parallel to the support beam 124 and the further support beam 132 of the base 108 and is perpendicular to the rails 128. The crossbar 208 is also coupled to the piston 160 of the lift mechanism 120 and is perpendicular to the piston 160 of the lift mechanism 120.

Like the first legs 180, each of the second legs 184 also includes a first end 212 and a second end 216. The first end 212 of each second leg 184 is rotatably coupled to a respective tab 168 of the support beam 124 of the base 108. In other words, each second leg 180 is able to rotate relative to the base 108 about a rotation axis 220 (shown in FIGS. 2 and 3) that is formed at the respective tab 168 in a direction parallel to the support beam 124. The second end 216 of each second leg 184 is slidably coupled to the support assembly 116. In the embodiment shown, each second end 216 includes a peg 224 configured to be received in a respective slot 228 formed in the support assembly 116. The pegs 224 slide within the slots 228 to slidably accommodate movement of the lift assembly 112 relative to the support assembly 116. In alternative embodiments, the pegs 224 can be formed differently and the slots 228 can be formed differently to slidably accommodate movement of the lift assembly 112 relative to the support assembly 116. For example, the slots 228 can be any sliding tracks and the pegs 224 can be any sliders configured to slide along the sliding tracks.

As shown, the lift device 100 has a symmetrical scissor configuration. Because the first legs 180 are coupled to the second legs 184 at the hinges 188, the first ends 212 of the second legs 184 are coupled to the tabs 168 of the base 180, and the second ends 200 of the first legs 180 are coupled together by the crossbar 208 of the lift mechanism 120, the pairs of scissor legs 176 operate in symmetry with one another relative to the base 108 such that both of the first legs 180 and both of the second legs 184 move together. The scissor configuration of the lift device 100 provides stability to the object supported by the support assembly 116 and, simultaneously, accessibility to the object supported by the support assembly 116.

In use, the hydraulic cylinder 156 defines the length L of the lift mechanism 120. When the piston 160 is extended out of the barrel 154 of the hydraulic cylinder 156, as shown in FIG. 3 the length L is longer than when the piston 160 is contracted into the barrel 152, as shown in FIG. 2. Accordingly, FIG. 3 depicts the lift device 100 in a lowered position and FIG. 2 depicts the lift device 100 in a raised position. When the power source 164 operates the hydraulic cylinder 156 to extend the piston 160 out of the barrel 154, the lift assembly 112 lowers the support assembly 116. Conversely, when the power source 164 operates the hydraulic cylinder 156 to contract the piston 160 into the barrel 154, the lift assembly 112 raises the support assembly 116.

One advantage of using a hydraulic pulling cylinder 156 in the lift device 100 is that when the lift device 100 is in the raised position, the piston 160 is contracted into the barrel 154, which protects the piston 160 from damage or impact from tools or other items while the object on the support assembly 116 is being acted upon.

More specifically, to raise the support assembly 116 relative to the base 108, the power source 164 operates the hydraulic cylinder 156 to contract the piston 160 into the barrel 154. As the piston 160 is drawn into the barrel 154, the crossbar 208 is drawn toward the support beam 124 of the base 108. Because the second ends 200 of the first legs 180 of the lift assembly 116 are coupled to the crossbar 208, as the crossbar 208 is drawn toward the support beam 124, the second ends 200 of the first legs 180 are drawn toward the first ends 212 of the second legs 184, which are coupled to the tabs 168 on the support beam 124. As the second ends 200 of the first legs 180 are drawn toward the first ends 212 of the second legs 184, the sliders 204 slide along the rails 128 of the base 108 to facilitate a smooth and even movement of the lift assembly 112.

Because the first legs 180 and the second legs 184 are coupled together at the hinges 188, as the second ends 200 of the first legs 180 are drawn toward the first ends 212 of the second legs 184, the second ends 216 of the second legs 184 are also drawn toward the first ends 196 of the first legs 180. The first ends 196 of the first legs 180 are rotatably fixed at the fixed locations 198 of the support assembly 116. Accordingly, the second ends 216 of the second legs 184 slide relative to the support assembly 116 via the pegs 224 and the slots 228. The height to which the support assembly 116 can be raised is dependent upon the length of the piston 160 and the barrel 154. When the piston 160 is fully received within the barrel 154, the support assembly 116 can be raised no higher.

To lower the support assembly 116 relative to the base 108, the power source 164 operates the hydraulic cylinder 156 to extend the piston 160 from the barrel 154. As the piston 160 is extended from the barrel 154, the crossbar 208 is pushed away from the support beam 124 of the base. Accordingly, the process for lowering the support assembly 116 relative to the base 108 is the opposite of the process for raising the support assembly 116 relative to the base 108. The lowest height to which the support assembly 116 can be lowered is dependent upon the length of the piston 160 and the barrel 154 relative to the rails 128. When the crossbar 208 of the lift mechanism 120 contacts the further support beam 132 of the lift assembly 112, the support assembly 116 can be lowered no lower. In the embodiment shown, the rails 128 are longer than the length L of the lift mechanism 120 when the piston 160 is fully extended from the barrel 154. Accordingly, the lowest height to which the support assembly 116 can be lowered is limited by the contact of the support assembly 116 with the hydraulic cylinder 156 of the lift mechanism 120. Thus, the lift device 100 has a low profile when the piston 160 is fully extended from the barrel 154. A low profile is advantageous because it facilitates loading and unloading an object from the support assembly 116 and because it reduces an amount of space taken up by the lift device 100 when stored.

In the embodiment shown, the power source 164 is actuated by a handle 232. The handle 232 can be configured such that raising the handle 232 relative to the base 108 operates the hydraulic cylinder 156 to contract the piston 160 into the barrel 154, thereby raising the support assembly 116. The handle 232 can be further configured such that lowering the handle 232 relative to the base 108 operates the hydraulic cylinder 156 to extend the piston 160 from the barrel 154, thereby lowering the support assembly 116. Alternatively, the handle 232 can be configured such that raising and lowering the handle 232 has the opposite result on the support assembly 116. As another alternative, the handle 232 can be used to control the rate at which the piston 160 is extended from or contracted into the barrel 154.

One advantage of the arrangement of the power source 164 on the outwardly facing surface 148 of the support beam 124 is that a lowermost surface 236 of the power source 164 can be coplanar with the lowermost surface 136 of the support beam 124. Accordingly, the power source 164 can be stably supported on the same surface as the base 108. Another advantage of the arrangement of the power source 164 on the outwardly facing surface 148 of the support beam 124 is that the power source 164 is spaced apart from the lift assembly 112 and support assembly 116, which are arranged inside the rectangular shape of the base 108. Accordingly, access to the object supported by the support assembly 116 is maximized.

As shown in FIG. 1, the support assembly 116 includes a first arm 236 and a second arm 240 coupled together by a cross member 244. The first arm 236 includes one of the fixed locations 198 whereat the first arm 236 is coupled to the first end 196 of the first leg 180 of one of the pairs of scissor legs 176. The first arm 236 further includes one of the slots 228 whereat the first arm 236 is coupled to the second end 216 of the second leg 184 of the pair of scissor legs 176. The first arm 236 is coupled to the cross member 244 at an end nearest to the fixed location 198. Similarly, the second arm 240 includes the other of the fixed location 198 whereat the second arm 240 is coupled to the first end 196 of the first leg 180 of the other of the pairs of scissor legs 176. The second arm 240 further includes the other of the slots 228 whereat the second arm 240 is coupled to the second end 216 of the second leg 184 of the other of the pairs of scissor legs 176. The second arm 240 is also coupled to the cross member 244 at an end nearest to the fixed location 198.

The first arm 236 and the second arm 240 are arranged parallel to and above the rails 128. The first arm 236 and the second arm 240 may or may not be aligned directly above the rails 128. The first arm 236 and the second arm 240 each include an uppermost surface 248 facing in a direction opposite the lowermost surface 136 of the support beam 124, rails 128, and further support beam 132. In the embodiment shown, the first arm 236 and the second arm 240 further include side walls 252 extending downwardly from the uppermost surface 248 in a direction toward the base 108. The slots 228 are formed in the side walls 252 such that the pegs 224 on the second ends 216 of the second legs 184 engage with the side walls 252 of the arms 236, 240. In the embodiment shown, the second ends 216 of the second legs 184 are arranged between the side walls 252 and within the legs 236, 240. In alternative embodiments, however, the slots 252 can be formed in other portions of the first and second arms 236, 240 besides the side walls 252 and the second ends 216 of the second legs 184 can engage with the first and second arms 236, 240 in a different manner. For example, the second ends 216 of the second legs 184 can be arranged outside the side walls 252.

The cross member 244 is coupled to the uppermost surface 248 and the side walls 252 of each of the first and second arms 236, 240. In the embodiment shown, the cross member 244 is formed as a flat plate. In alternative embodiments, the cross member 244 can have other forms which extend between the first and second arms 236, 240 to couple the first and second arms 236, 240 together. The cross member 244 is parallel to the crossbar 208 of the lift mechanism 120. In the embodiment shown, the cross member 244 includes a notch 254 which is open toward the base 108 and is configured to accommodate the hydraulic cylinder 156 of the lift mechanism 120. Accordingly, the notch 254 enables the lift device 100 to be lowered to a lower lowermost position by partially accommodating the barrel 154 of the hydraulic cylinder 156 before the cross member 244 of the support assembly 116 contacts the lift mechanism 120.

The support assembly 116 further includes a pair of support pads 256 arranged on the uppermost surface 248 of each of the first and second arms 236, 240. The support pads 256 are configured to contact and support the object being supported on the support assembly 116. The support pads 256 are made of a softer, more pliable material than the first and second arms 236, 240 to protect the object from being damaged by contact with the first and second arms 236. Furthermore, the support pads 256 provide additional stability to the object.

The support assembly 116 further includes an adjustment mechanism 260 coupled to each of the pairs of support pads 256. In other words, one adjustment mechanism 260 is coupled to the support pads 256 on the first arm 236 and another adjustment mechanism 260 is coupled to the support pads 256 on the second arm 240. The adjustment mechanisms 260 are configured to move the support pads 256 along the first and second arms 236, 240. In the embodiment shown, each adjustment mechanism 260 includes a knob 272 which is rotated in a first direction relative to the cross member 244 to draw the support pads 256 arranged on the same arm toward one another along the arm and rotated in a second direction relative to the cross member 244 to force the support pads 256 arranged on the same arm away from one another along the arm. By moving the support pads 256 along the arms 236, 240, the support assembly 116 is adjustable to provide support and stability to various positions on the support assembly 116. In other words, the support pads 256 are movable to provide versatility for supporting various objects having various centers of mass and various shapes.

Figure 4A:
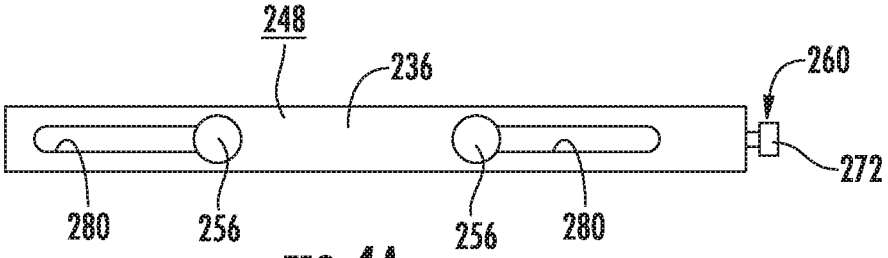
FIG. 4A depicts a top view of an adjustment mechanism for use in the lift device of FIG. 1.
Figure 4B:
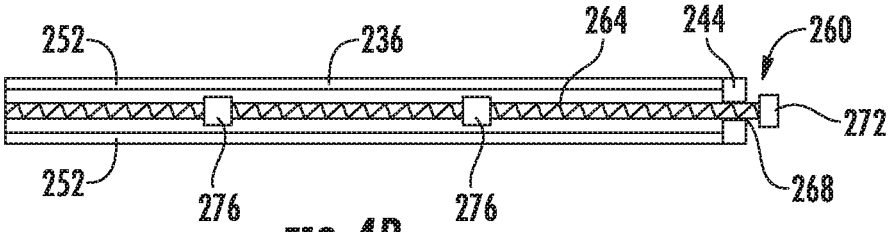
FIG. 4B depicts a bottom view of the adjustment mechanism of FIG. 1.
Figure 4C:
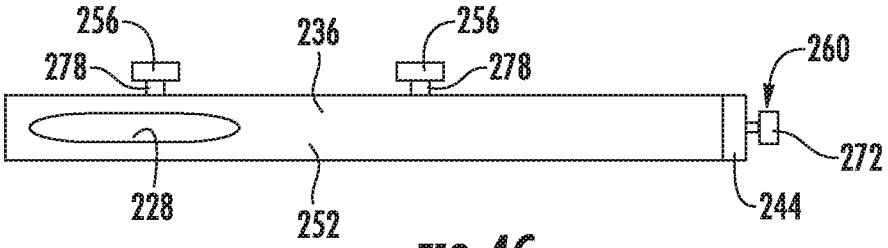
FIG. 4C depicts a side view of the adjustment mechanism of FIG. 1.

An exemplary embodiment of the adjustment mechanisms 260 is shown in FIGS. 4A-4C. For this description, the adjustment mechanism 260 is shown with the first arm 236. However, an identical adjustment mechanism 260 can be used with the second arm 240. As shown in FIG. 4B, the adjustment mechanism 260 includes a threaded rod 264 arranged between the side walls 252 within the arm 236. The threaded rod 264 extends through an opening 268 formed in the cross member 244 and includes the knob 272 arranged outside the arm 236 on the other side of the cross member 244. The knob 272 is fixedly coupled to the threaded rod 264 such that rotation of the knob 272 rotates the threaded rod 264. The adjustment mechanism 260 further includes a threaded nut 276 fixedly coupled to each of the support pads 256 by a coupling 278 (shown in FIG. 4C) and threaded onto the threaded rod 264.

When the threaded rod 264 is rotated via the knob 272, the threaded nuts 276 travel along the arm 236 and carry the support pads 256 along the arm 236. The threaded nuts 276 are threaded in opposite directions such that rotation of the threaded rod 264 causes the threaded nuts 276 to travel in opposite directions along the arm 236. Accordingly, rotation of the threaded rod 264 in a first direction brings the threaded nuts 276, and the support pads 256, closer to one another along the arm 236 and rotation of the threaded rod 264 in an opposite second direction moves the threaded nuts 276, and the support pads 256, apart from one another along the arm 236.

As shown in FIG. 4A, the uppermost surface 248 of the arm 236 includes slots 280 configured to accommodate the coupling 278 (shown in FIG. 4C) of the support pads 256, which are arranged on top of the arm 236, with the threaded nuts 276, which are arranged on the threaded rod 264 within the arm 236. Each slot 280 is formed along the arm 236 and the range of movement of the support pad 256 is limited by contact of the coupling 278 with the ends of the slot 280.

The adjustment mechanisms 260 are arranged within the arms 236, 240 such that the threaded rods 264 and threaded nuts 276 do not interfere with the movement of the second ends 216 of the second legs 184 relative to the arms 236, 240 of the support assembly 116 or movement of the pegs 224 within the slots 228 formed in the side walls 252 of the arms 236, 240. Accordingly, the threaded rod 264 of the adjustment mechanism 260 is not visible through the slot 228 formed in the side wall 252 in FIG. 4C. The adjustment mechanisms 260 are operable independently of one another such that the support pads 256 of the first arm 236 can be spaced at a different distance than the support pads 256 of the second arm 240.

In alternative embodiments, the adjustment mechanism 260 can include different features and be arranged in a different manner such that the adjustment mechanism 260 is operable to bring the support pads 256 closer to one another and move the support pads 256 away from one another along the arm 236, 240 without interfering with the movement of the lift assembly 112 relative to the support assembly 116.

In at least one embodiment, the support pads 256 are threadably coupled to the respective coupling 278 such that rotating each support pad 256 relative to its respective coupling 278 moves the support pad 256 vertically relative to the arm 236. In other words, rotating the support pad 256 in a first direction relative to the coupling 278 moves the support pad 256 vertically toward the arm 236, and rotating the support pad 256 in a second direction, opposite the first direction, relative to the coupling 278 moves the support pad 256 vertically away from the arm 236. The vertical adjustability of each support pad 256 further enhances the versatility of the support assembly 116 by enabling the support pads 256 to accommodate various portions of the object having various heights relative to one another. In alternative embodiments, the support pads 256 can be coupled to the couplings 278 in a different manner so as to enable vertical adjustability of the support pads 256 relative to the arms 236, 240.

While the disclosure has been illustrated and described in detail in the drawings and foregoing description, the same should be considered as illustrative and not restrictive in character. It is understood that only the preferred embodiments have been presented and that all changes, modifications, and further applications that come within the spirit of the disclosure are desired to be protected.

What is claimed is:

1. A lift device configured to lift an object, comprising:

a base for supporting the lift device on a surface;

a support assembly movably coupled to the base and configured to support the object, the support assembly including:

a first arm and a second arm connected by a cross member;

at least one first pad movably supported by the first arm and arranged directly above the first arm;

at least one second pad movably supported by the second arm and arranged directly above the second arm;

at least one first adjustment mechanism configured to adjust a location of the at least one first pad along the first arm; and at least one second adjustment mechanism configured to adjust a location of the at least one second pad along the first arm;

a lift mechanism configured to raise and lower the support assembly relative to the base, the lift mechanism including a hydraulic cylinder, the hydraulic cylinder coupled to the base and to the support assembly such that drawing a piston of the hydraulic cylinder into a barrel of the hydraulic cylinder moves the support assembly upwardly, and extending the piston out of the barrel moves the support assembly downwardly; and a lift assembly coupled to the support assembly, the base, and the lift mechanism, the lift assembly including two first legs rotatably coupled to the support assembly and slidably coupled to the base, wherein the lift mechanism includes a crossbar rotatably coupled to the first two legs in such a way that drawing the piston into the barrel and extending the piston out of the barrel causes rotation of the two first legs relative to the crossbar, and the piston is fixedly coupled directly to the crossbar.

2. The lift device of claim 1, wherein the at least one first pad and the at least one second pad support the object on the support assembly.

3. The lift device of claim 1, wherein the at least one first arm and the at least one second arm are parallel to one another and spaced apart from one another by an opening.

4. The lift device of claim 1, wherein:

the at least one first adjustment mechanism includes a first knob configured to rotate a first rod to adjust the location of the at least one first pad on the first arm; and the at least one second adjustment mechanism includes a second knob configured to rotate a second rod to adjust the location of the at least one second pad on the second arm.

5. The lift device of claim 4, wherein:

the at least one first pad includes two first pads movably coupled to the first rod; and the at least one second pad includes two second pads movably coupled to the second rod.

6. The lift device of claim 5, wherein:

rotating the first rod moves the two first pads in opposite directions relative to one another; and rotating the second rod moves the two second pads in opposite directions relative to one another.

7. The lift device of claim 6, wherein:

each of the first and second arms includes two side walls extending downwardly from the upper surface of the respective first and second arm;

the first rod extends in a longitudinal direction of the first arm between the two sidewalls of the first arm; and the second rod extends in a longitudinal direction of the second arm between the two sidewalls of the second arm.

8. The lift device of claim 7, wherein:

the at least one first adjustment mechanism further includes at least one first coupling configured to movably couple the at least one first pad to the first rod, the at least one first coupling positioned between the two sidewalls of the first arm;

an upper surface of the first arm defines at least one slot configured to receive the at least one first coupling therethrough to couple the first rod inside the first arm to the at least one first pad, which is outside the first arm;

the at least one second adjustment mechanism further includes at least one second coupling configured to movably couple the at least one second pad to the second rod, the at least one second coupling positioned between the two sidewalls of the second arm; and an upper surface of the second arm defines at least one slot configured to receive the at least one second coupling therethrough to couple the second rod inside the second arm to the at least one second pad, which is outside the second arm.

9. The lift device of claim 8, wherein:

the cross member includes at least one opening configured to receive the first rod and the second rod therethrough such that the first knob and the second knob are arranged on one side of the cross member and the first rod and the second rod are arranged on an opposite side of the cross member.

* * * * *